United States Patent [19]

Nestler

[11] Patent Number: 5,042,211

[45] Date of Patent: Aug. 27, 1991

[54] EXPANSION JOINT

[76] Inventor: Randolph M. Nestler, 249 Moore St., Millersburg, Pa. 17601

[21] Appl. No.: 418,174

[22] Filed: Oct. 6, 1989

Related U.S. Application Data

[63] Continuation-in-part of Ser. No. 141,256, Jan. 6, 1988, abandoned.

[51] Int. Cl.[5] ..... E04B 1/62

[52] U.S. Cl. ..... 52/396; 52/523; 404/67

[58] Field of Search ..... 52/396, 403, 573; 404/66, 67, 68

[56] References Cited

U.S. PATENT DOCUMENTS

| | | | |
|---|---|---|---|
| 2,405,844 | 8/1946 | Mortenson | 94/8 |
| 2,948,994 | 8/1960 | Thom | 50/173 |
| 3,166,816 | 1/1965 | Berg | 25/128 |
| 3,286,425 | 11/1966 | Brown | 52/403 X |
| 3,395,507 | 8/1968 | Moody | 52/390 |
| 3,508,369 | 4/1970 | Tennison | 52/396 |
| 3,871,787 | 3/1975 | Stegmeier | 404/48 |
| 3,899,260 | 8/1975 | Kerschner | 52/403 X |
| 3,903,587 | 9/1975 | Boiardi | 29/418 |
| 4,198,176 | 4/1980 | Bentz | 404/68 |
| 4,651,488 | 3/1987 | Nicholas et al. | 52/396 |
| 4,815,247 | 3/1989 | Nicholas | 52/396 |

FOREIGN PATENT DOCUMENTS

| | | | |
|---|---|---|---|
| 286295 | 3/1965 | Australia | 52/573 |
| 1260252 | 5/1960 | France | 52/573 |

*Primary Examiner*—David A. Scherbel
*Assistant Examiner*—Creighton Smith
*Attorney, Agent, or Firm*—Thomas Hooker

[57] ABSTRACT

An expansion joint for forming an adjacent seal between concrete slabs includes a foot for holding the joint in place during pouring of one slab and resilient longitudinal reinforcing elements for maintaining contact between the joint and the ends of the slabs during thermal expansion and retraction of the slabs.

18 Claims, 1 Drawing Sheet

EXPANSION JOINT

This application is a continuation-in-part of my copending U.S. patent application Ser. No. 141,256, filed Jan. 6, 1988.

FIELD OF THE INVENTION

The invention relates to joints placed between adjacent concrete slabs for preventing water from flowing between the slabs while permitting thermal expansion and contraction of the slabs.

DESCRIPTION OF THE PRIOR ART

Cast concrete slabs are used for roadways, sidewalks, driveways and the like. The slabs have a coefficient of thermal expansion requiring that space be provided between adjacent slabs to allow the slabs to expand and contract thermally without stressing the slabs sufficiently to fracture or rupture the concrete. It is conventional to provide for thermal expansion of the slabs by placing asphalt treated mat expansion joints between the adjacent slabs. These joints are resilient and permit expansion of the concrete.

Asphalt joints have a number of disadvantages. The joints are flexible and must be backed up by a board during pouring. Also, these joints can easily float when the liquid concrete is poured into the form. The backup board must be kept in place while pouring the adjacent slab. After the adjacent slab is poured the board is removed, taking care to maintain the asphalt joint in place and the contractor must fill additional concrete into the space previously occupied by the board. This is a time consuming and inefficient process.

In time, conventional asphalt joints tend to become compressed and separate from the ends of the adjacent slabs, allowing water to flow down into the spaced between the slabs. This water may freeze, expand and injure the slabs. Also, the asphalt joints tend to work up above the top of the slabs forming well known highway "bumps". Working up of asphalt joints creates voids in the space between the slabs where water can collect, freeze and injure the slabs. The seal between the joints and the slabs is also degraded.

SUMMARY OF THE INVENTION

The disclosed expansion joint includes a hollow rectangular body with a retaining foot at the bottom of the body. The joint is sufficiently rigid to permit use as a forming wall at one end of a form for pouring a first adjacent concrete slab. The foot extends into the form so that the concrete overlies the foot and prevents floating of the joint. The joint also forms one wall of the form for pouring the second concrete slab on the other side of the joint.

The hollow body includes a pair of spaced walls separated by resilient reinforcing elements which permit lateral movement of the front and rear walls in response to thermal expansion of the adjacent slabs while maintaining contact between the walls and the slabs. When the slabs cool and contract the reinforcing elements bias the walls apart to maintain contact with the slabs.

The expansion joint is preferably extruded from a stiffly flexible plastic material such as polyvinyl chloride with integral longitudinally extending reinforcing elements between the front and rear walls. In addition to maintaining contact between the walls and the adjacent slabs the reinforcing elements divide the interior space between the walls into separate independent cavities. The cavities assure that in the event the top wall of the joint is worn away water flowing into the body is captured by the first reinforcing element and cannot flow down along the joint and into the space between the concrete slabs. Rather, the water flows along the length of the joint and out the end of the joint.

Other objects and features of the invention will become apparent as the description proceeds, especially when taken in conjunction with the accompanying drawings illustrating the invention, of which there is one sheet and two embodiments.

DESCRIPTION OF THE PREFERRED EMBODIMENTS

Figure 1:
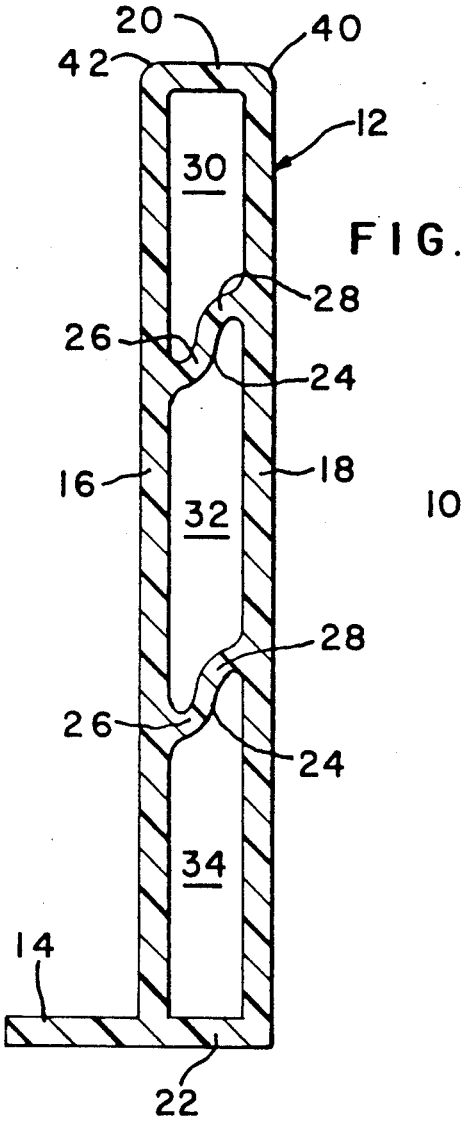
FIG. 1 is a sectional view taken through an expansion joint according to the invention.

FIG. 1 is a transverse cross sectional view taken through an indefinite length expansion joint 10. The joint is preferably extruded from a plastic, such as PVC, or other stiffly flexible material and has a uniform transverse cross section. Joint 10 includes a hollow upright rectangular body 12 with a foot 14 at the bottom of the body. The body has front wall 16, rear wall 18 and top and bottom walls 20 and 22. A pair of longitudinal reinforcing elements 24 extend between the front and rear walls 16 and 18 at spaced locations between the top and bottom walls. Each element has a shallow S-shape in cross section as shown in FIG. 1 and includes a curved portion 26 extending upwardly from front wall 16 and a curved portion 28 extending downwardly from rear wall 18. Portion 26 is located below portion 28 so that the reinforcing element 24 extends diagonally upwardly from wall 16 to wall 18.

The reinforcing elements are integral with body 12. The two elements 24 are spaced between the top and bottom walls to define three separate, approximately equal interior cavities 30, 32 and 34 which are open at the ends of joint 10. Foot 14 extends a short distance perpendicularly away from the bottom of front wall 16 and forms a continuation of bottom wall 22.

Figure 2:
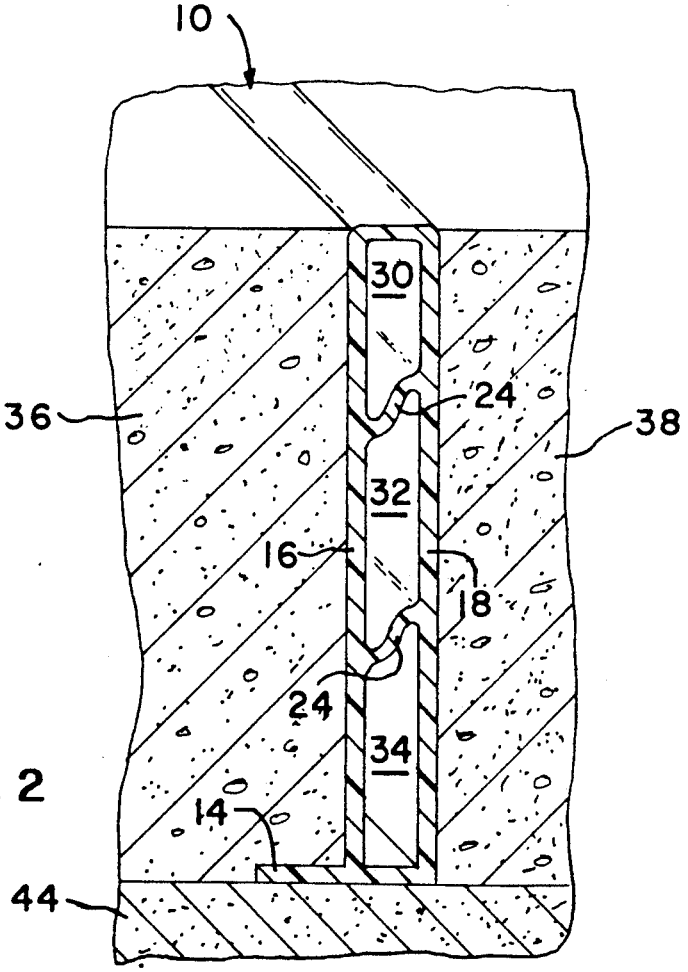
FIG. 2 is a sectional view showing the expansion joint in place between adjacent concrete slabs.

Joint 10 is positioned between cast concrete slabs 36 and 38 as shown in FIG. 2. In preparing to cast the slabs, an appropriate length of joint 10 is cut from stock material and is pinned in place to form one wall for the slab 36 with pins extending along the outside of rear wall 18 to hold the joint in place and with foot 14 extending into the space to be filled by the concrete forming the slab. Concrete is then poured into the space overlying the foot and extending up along the front wall 16 to the full height of the joint. The weight of the liquid concrete overlying foot 14 prevents the joint from floating up. The pins behind the joint prevent outer deformation of the joint.

Prior to pouring the concrete for slab 36 the space for concrete forming slab 38 is formed up and readied to be poured. Following pouring of slab 36 concrete forming slab 38 is poured on the opposite side of the joint. The reinforcing pins supporting rear wall 18 are then pulled and the liquid concrete fills in the pin holes. The pouring operation is completed by smoothing the top surfaces of the concrete and forming slight grooves in the concrete to either side of the rounded corners 40 and 42 at the top of joint 10. Joints 10 may be used as described for pouring a whole series of adjacent concrete slabs with joints separating adjacent slabs. Typically, the joints are used between sidewalk slabs, driveway and garage slabs, highway slabs and the like.

When poured, the concrete to either side of joint 10 is liquid and flows against and forms a close seal with the front and rear walls 16 and 18. When heated the set concrete slabs thermally expand and compress the joint to move walls 16 and 18 toward each other. Compression of the joint elastically deforms the reinforcing elements 24, collapsing the elements. The elements expand with contraction of the slabs. The resiliency of the elements maintains the seal between the joint and the ends of the slabs during thermal expansion and contraction.

During expansion, the top wall 20 may be flexed outwardly. If desired, the top of the wall may be domed somewhat to facilitate outward flexing. Likewise, bottom wall 22 may be flexed downwardly into subsurface 44. In some cases, expansion of the adjacent concrete slabs may fracture the bottom wall 22 without otherwise injuring the joint.

The resilient reinforcing elements 24 maintain the seal between adjacent concrete slabs 36 and 38. This seal is important when joint 10 is used between adjacent slabs of a highway where it is essential to prevent water from migrating down between the slabs. Downward migration of water, particularly salt contaminated water, increases the risk of corrosion of bridges or other roadway support structure and supplies pools of water which expand when frozen and injure the concrete slabs.

Gradual erosion of the roadway surface through wear may wear away top wall 20. In this event, the upper reinforcing element 24 closes the top of the joint and forms a barrier preventing downward migration of water through the joint. Water is collected in the open joint above the upper reinforcing element 24 and flows along the element for discharge at the end of the joint away from the slabs.

Figure 3:
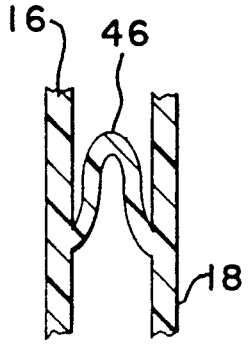
FIG. 3 is a partial sectional view of a second embodiment expansion joint.

Expansion joint 10 is provided with two resilient longitudinal reinforcing elements 24 each having a shallow S-shape. It is intended that other shaped joints may be used. For instance, the expansion joint 10 may be provided with U-shaped reinforcing elements 46 as shown in FIG. 3. Both elements 24 and 46 are resiliently collapsible when the concrete slabs expand. During collapse of joint 10 the elements 24 or 46 are elastically moved together without fracturing or shifting of the sidewalls 16 or 18. During expansion of the joint the elements hold the walls against the slabs. In this way, the joint is maintained in contact with the slabs without lifting or shifting of the side and rear walls.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An expansion joint adapted to be positioned between two adjacent poured slabs, the joint including an elongate hollow upright body formed from a stiffly flexible plastic material, the body having a top, a bottom and spaced apart front and rear walls; stiffly flexible reinforcing means located within the interior of the body between the front and rear walls for permitting movement of the front and rear walls toward and away from each other in response to thermal expansion and contraction of the slabs while maintaining contact with the slabs; and a foot located at the bottom of the front wall and extending generally perpendicularly outwardly from the front wall, the foot forming an extension of the bottom wall and being adapted to underlie one of the slabs.

2. An expansion joint as in claim 1 wherein the body is formed from a plastic extrusion and has a uniform transverse cross section.

3. An expansion joint as in claim 2 wherein the reinforcing means is integral with the body.

4. An expansion joint as in claim 1 wherein the body is integral and reinforcing means comprises a stiffly flexible element extending between the front and rear walls.

5. An expansion joint as in claim 4 wherein the element is curved.

6. An expansion joint as in claim 4 wherein the body is generally rectangular and includes top and bottom walls and the reinforcing element is integral with one of the front and rear walls.

7. An expansion joint as in claim 6 wherein the reinforcing element is integral with both the front and rear walls.

8. An expansion joint as in claim 7 including a plurality of like reinforcing elements extending between the front and rear walls, the elements dividing the interior of the body into separate cavities.

9. An expansion joint as in claim 7 wherein the reinforcing element is generally S-shaped in cross section and extends diagonally across the body.

10. An expansion joint as in claim 9 wherein the reinforcing element includes downwardly curved and upwardly curved portions adjacent the front and rear walls.

11. An expansion joint as in claim 7 wherein the reinforcing element is generally U-shaped in transverse cross section.

12. An expansion joint as in claim 7 wherein the foot is integral with the body and forms an extension of the bottom wall.

13. An extruded plastic expansion joint adapted to be positioned between two adjacent poured slabs, the joint having a uniform cross section and including a hollow upright rectangular body having top, bottom front and rear walls, a first stiffly flexible reinforcing element integrally joined to both the front and rear walls and extending across the interior of the body, and a foot at the lower end of the front wall, the foot projecting generally perpendicularly outwardly from the front wall at the bottom wall and forming an extension of the bottom wall.

14. An expansion joint as in claim 13 including a second reinforcing element like said first reinforcing element, said elements being spaced along the height of the body to divide the interior of the body into three separate interior cavities.

15. An expansion joint as in claim 14 wherein each reinforcing element extends diagonally between the front and rear walls.

16. An expansion joint as in claim 15 wherein the reinforcing elements are generally S-shaped.

17. An expansion joint as in claim 14 wherein the reinforcing elements are generally U-shaped.

18. An expansion joint as in claim 1 wherein said foot and bottom wall are generally flat and co-planar.

* * * * *